US006536380B1

(12) United States Patent
Kral et al.

(10) Patent No.: US 6,536,380 B1
(45) Date of Patent: Mar. 25, 2003

(54) FOSSIL-FUEL HEATED STEAM GENERATOR, COMPRISING DENTRIFICATION DEVICE FOR HEATING GAS

(75) Inventors: Rudolf Kral, Erlangen (DE); Josef Pulec, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/019,113

(22) PCT Filed: Jun. 13, 2000

(86) PCT No.: PCT/DE00/01941

§ 371 (c)(1),
(2), (4) Date: Dec. 21, 2000

(87) PCT Pub. No.: WO01/01040

PCT Pub. Date: Jan. 4, 2001

(30) Foreign Application Priority Data

Jun. 24, 1999 (DE) ..... 199 29 088

(51) Int. Cl.[7] ..... F22G 3/00
(52) U.S. Cl. ..... 122/406.4; 122/6 A; 122/406.3
(58) Field of Search ..... 122/1 B, 1 C, 122/6 A, 406.4, 406.3, 451 S, 459, 460; 422/170, 171, 172

(56) References Cited

U.S. PATENT DOCUMENTS 3,527,261 A 9/1970 Bigler et al.
3,556,059 A * 1/1971 Gorzegno et al. ..... 122/406.4
3,872,836 A * 3/1975 Gorzegno et al. ..... 122/406.4
4,075,979 A * 2/1978 Michel ..... 122/406.4
4,632,064 A * 12/1986 Haneda et al. ..... 122/1 A

FOREIGN PATENT DOCUMENTS

DE 36 16 095 C2 11/1986
EP 0 745 807 A1 12/1996
EP 0 753 701 A1 1/1997

OTHER PUBLICATIONS

Von J. Franke et al.: "Verdampferkonzepte für Benson®–Dampferzeuger", VGB Kraftwerkstechnik 73, pp. 352–361, 1993.

* cited by examiner

*Primary Examiner*—Gregory A. Wilson
(74) *Attorney, Agent, or Firm*—Harness, Dickey & Pierce PLC

(57) ABSTRACT

A steam generator has a nitrogen removal device for fuel gas and a combustion chamber, which is followed on the fuel-gas side, via a horizontal gas flue and a vertical gas flue, by a nitrogen removal device for the fuel gas. The steam generator has a particularly low space requirement and ensures a reliable removal of nitrogen from the fuel gases of the fossil fuel. For this purpose, the combustion chamber has a number of burners arranged level with the horizontal gas flue. Moreover, the vertical gas flue is designed for substantially vertical flow of the fuel gas from the bottom upward, and the nitrogen removal device for fuel gas is designed for an substantially vertical flow of the fuel gas from the top downward.

25 Claims, 3 Drawing Sheets

FOSSIL-FUEL HEATED STEAM GENERATOR, COMPRISING DENTRIFICATION DEVICE FOR HEATING GAS

This application is the national phase under 35 U.S.C. §371 of PCT International Application No. PCT/DE00/01941 which has an International filing date of Jun. 13, 2000, which designated the United States of America, the entire contents of which are hereby incorporated by reference.

FIELD OF THE INVENTION

The invention generally relates to a steam generator with a nitrogen removal device for fuel gas and with a combustion chamber for fossil fuel which is followed on the fuel-gas side, via a horizontal gas flue and a vertical gas flue, by the nitrogen removal device for fuel gas.

BACKGROUND OF THE INVENTION

In a power plant with a steam generator, the fuel gas generated during the combustion of a fossil fuel is used for the evaporation of a flow medium in the steam generator. For the evaporation of the flow medium, the steam generator has evaporator tubes, of which the heating by fuel gas leads to an evaporation of the flow medium carried in them. The steam provided by the steam generator may, in turn, be provided, for example, for a connected external process, or for driving a steam turbine. When the steam drives a steam turbine, a generator or a working machine is normally operated via the turbine shaft of the steam turbine. Where a generator is concerned, the current generated by the generator may be provided for feeding into an interconnected and/or island network.

The steam generator may in this case be designed as a continuous-flow steam generator. A continuous-flow steam generator is known from the paper "Verdampferkonzepte für Benson-Dampferzeuger" ["Evaporator concepts for Benson Steam Generators"] by J. Franke, W. Köhler and E. Wittchow, published in VGB Kraftwerkstechnik 73 (1993), No. 4, p. 352–360. In a continuous-flow steam generator, the heating of steam generator tubes, provided as evaporator tubes, leads to an evaporation of the flow medium in the steam generator tubes in a single pass.

Steam generators are usually designed with a combustion chamber in a vertical form of construction. This means that the combustion chamber is designed for the heating medium or fuel gas to flow through in an approximately vertical direction. In this case, the combustion chamber may be followed, on the fuel-gas side, by a horizontal gas flue, a deflection of the fuel-gas stream into an approximately horizontal flow direction taking place at the transition from the combustion chamber into the horizontal gas flue. In general, however, because of the thermally induced changes in length of the combustion chamber, combustion chambers of this type require a framework on which the combustion chamber is suspended. This necessitates a considerable technical outlay in terms of the production and assembly of the steam generator, this outlay being higher, the greater the overall height of the steam generator is.

A particular problem is the design of the containment wall of the gas flue or combustion chamber of the steam generator with regard to the tube-wall or material temperatures which occur there. In the subcritical pressure range to about 200 bar, the temperature of the containment wall of the combustion chamber may be determined by the height of the saturation temperature of the water. This is achieved, for example, using evaporator tubes which have a surface structure on their inside. Consideration is given, in this respect, to internally ribbed evaporator tubes, of which the use in a continuous-flow steam generator is known, for example, from the abovementioned paper. These ribbed tubes, that is to say tubes with a ribbed inner surface, have particularly good heat transmission from the tube inner wall to the flow medium.

To reduce the nitrogen oxides in the fuel gas of the fossil fuel, the method of selective catalytic reduction, which is known as the SCR method, may be used. In the SCR method, nitrogen oxides ($NO_x$) are reduced to nitrogen ($N_2$) and water ($H_2O$) with the aid of a reducing agent, for example ammonia, and a catalyst.

In a steam generator designed for an SCR method, a nitrogen removal device for fuel gas, with a catalyst, is conventionally arranged downstream of the fuel-gas duct, which is designed as a convection flue and where the fuel gas normally has a temperature of about 320 to 400° C. The catalyst of the nitrogen removal device for fuel gas serves to initiate and/or maintain a reaction between the reducing agent introduced in the fuel gas and the nitrogen oxides of the fuel gas. The reducing agent required for the SCR method is in this case usually injected, together with air as a carrier stream, into the fuel gas flowing through the gas flue. However, as a rule, the nitrogen oxide emission of the steam generator depends on the type of fossil fuel burnt. Therefore, in order to adhere to the legally prescribed limit values, the reducing agent quantity to be injected is normally varied as a function of the fossil fuel used.

However, a nitrogen removal device for fuel gas, arranged downstream of the convection flue on the outlet side, requires a considerable outlay in structural and production terms for the respective steam generator. This is because the nitrogen removal device has to be arranged in the steam generator in a place where it can exert a particularly high purifying effect on the fuel gas in all the operating states of the steam generator. This is normally the case where the fuel gas has a temperature in the range of about 320 to 400° C. Moreover, the outlay in terms of the production of a steam generator increases when the latter has, as well as conventional components, a nitrogen removal device in addition.

SUMMARY OF THE INVENTION

An object on which the invention is based is, therefore, to specify a fossil-fired steam generator of the abovementioned type, which requires a particularly low outlay in structural and production terms and in which a purification of the fuel gas of the fossil fuel is ensured particularly reliably, before these leave the steam generator on the outlet side.

This object is achieved, according to the invention, in that the combustion chamber of the steam generator includes a number of burners arranged level with the horizontal gas flue, the vertical gas flue being designed for an approximately vertical flow of the flue gas from the bottom upward and the nitrogen removal device for fuel gas being designed for an approximately vertical flow of the fuel gas from the top downward.

The invention proceeds from the notion that a steam generator capable of being erected at a particularly low outlay in production and assembly terms should have a suspension structure capable of being produced in a simple manner. A framework, to be erected at a comparatively low technical outlay, for the suspension of the combustion chamber may at the same time be accompanied by a particularly low overall height of the steam generator. A particularly low overall height of the steam generator can be achieved by the combustion chamber being designed in a horizontal form of construction. For this purpose, the burners are arranged, level with the horizontal gas flue, in the combustion chamber wall. Thus, when the steam generator is in operation, the flue gas flows through the combustion chamber in an approximately horizontal direction.

For a particularly reliable purification of the fuel gas of the fossil fuel, the nitrogen removal device for fuel gas may be arranged downstream of the vertical gas flue on the outlet side. To be precise, downstream of the vertical gas flue on the outlet side, the fuel gas has temperatures at which a purification of the fuel gas takes place particularly effectively at a low technical outlay. It must be remembered, in this case, that, for a particularly low overall height of the steam generator, the nitrogen removal device for fuel gas may be designed for an approximately vertical flow of the fuel gas from the top downward. It is thereby possible for the liquid necessary in the SCR method, together with ammonia fractions, to be injected in the main flow direction of the fuel gas, with the result that the nitrogen removal device has a particularly small vertical extent.

However, in a steam generator with a combustion chamber, through which fuel gas can flow in an approximately horizontal main flow direction, the fuel gases, after leaving the horizontal gas flue, flow downward in the vertical gas flue. In order to cause the fuel gas to flow approximately vertically from the top downward in the nitrogen removal device for fuel gas, it is therefore necessary to have a duct for the fuel gas, in which the fuel gas is guided from the bottom upward downstream of the vertical gas flue on the outlet side, in order then to enter the nitrogen removal device for fuel gas, through which said fuel gas is capable of flowing from the top downward. This additional duct is not desirable when the vertical gas flue is designed for an approximately vertical flow of the fuel gas from the bottom upward and the nitrogen removal device provided for the fuel gas is designed for an approximately vertical flow of the fuel gas from the top downward.

Advantageously, the purified flue gas leaving the nitrogen removal device for fuel gas can be used for the heating of air in an air preheater. The air preheater should in this case be arranged directly below the nitrogen removal device for fuel gas in a particularly space-saving way. The preheated air is to be supplied to the burners of the steam generator for the combustion of the fossil fuel. When hot air, in contrast to cold air, is supplied to the burners during the combustion of the fossil fuel, the overall efficiency of the steam generator rises.

The nitrogen removal device for fuel gas advantageously comprises a $DeNO_x$ catalyst. This is because a reduction in the nitrogen oxides of the fuel gas leaving the steam generator can then be carried out in a particularly simple way, for example by way of the method of selective catalytic reduction.

The containment walls of the combustion chamber are advantageously formed from vertically arranged evaporator tubes which are welded to one another in a gastight manner and a number of which are in each case capable of being acted upon in parallel by flow medium.

Advantageously, one containment wall of the combustion chamber is the end wall and two containment walls of the combustion chamber are the side walls, The side walls in each case are subdivided into a first group and a second group of evaporator tubes. The end wall and the first group of evaporator tubes are capable of being acted upon in parallel by a flow medium and, on the flow-medium side, the preceding second group of evaporator tubes are capable of being acted upon in parallel by the flow medium. Therefore, particularly favorable cooling of the end wall is thereby ensured.

Advantageously, the evaporator tubes capable in each case of being acted upon in parallel by the flow medium are, on the flow-medium side, preceded by a common inlet header system and followed by a common outlet header system. A steam generator designed in this configuration allows reliable pressure compensation between the parallel-connected evaporator tubes and therefore a particularly favorable distribution of the flow medium during the flow through the evaporator tubes.

In a further advantageous refinement, the inside tube diameter of a number of the evaporator tubes of the combustion chamber is selected as a function of the respective position of the evaporator tubes in the combustion chamber. The evaporator tubes in the combustion chamber may thereby be adapted to a heating profile predeterminable on the gas side. By the influence brought about thereby on the flow through the evaporator tubes, temperature differences at the outlet of the evaporator tubes of the combustion chamber are kept low in a particularly reliable way.

For a particularly good transmission of the heat of the combustion chamber to the flow medium guided in the evaporator tubes, a number of the evaporator tubes advantageously have on the inside thereof ribs forming a multi-flight thread. In this case, advantageously, a pitch angle $\alpha$ between a plane perpendicular to the tube axis and the flanks of the ribs arranged on the tube inside is smaller than 60°, preferably smaller than 55°.

To be precise, in a heated evaporator tube designed as an evaporator tube without internal ribbing, what may be referred to as a smooth tube, the wetting of the tube wall, necessary for a particularly good heat transmission, may no longer be maintained beyond a specific steam content. In the absence of wetting, there may be a tube wall which is dry at particular points. The transition to a dry tube wall of this type leads to a kind of heat transmission crisis with an impaired heat transmission behavior, so that, in general, the tube-wall temperatures at this point rise particularly sharply.

In an internally ribbed tube, however, as compared with a smooth tube, this heat transmission crisis occurs only in the case of a steam mass content >0.9, that is to say just before the end of evaporation. This is attributable to the swirl which the flow experiences due to the spiral ribs. By virtue of the differing centrifugal force, the water fraction is separated from the steam fraction and is pressed onto the tube wall. The wetting of the tube wall is thereby maintained up to high steam contents, so that high flow velocities prevail even at the location of the heat transmission crisis. This gives rise, despite the heat transmission crisis, to a good heat transmission and, consequently, to low tube-wall temperatures.

A number of the evaporator tubes of the combustion chamber advantageously have the capability for reducing the throughflow of the flow medium. In this case, it proves to be particularly beneficial if the capability is designed as throttle devices. Throttle devices may, for example, be fittings which are built into the evaporator tubes and which reduce the tube inside diameter at a point within the respective evaporator tube.

In this case, it also proves advantageous to have the capability for reducing the throughflow in a line system which includes a plurality of parallel lines and through which flow medium can be supplied to the evaporator tubes of the combustion chamber. At the same time, the line system may also precede an inlet header system of parallel evaporator tubes capable of being acted upon by flow medium. In this case, for example, throttle fittings may be provided in one line or in a plurality of lines of the line system. By such means for reducing the throughflow of the flow medium through the evaporator tubes, the throughput of the flow medium through individual evaporator tubes may be adapted to the respective heating of these in the combustion chamber. As a result, in addition, temperature differences of the flow medium at the outlet of the evaporator tubes may be kept particularly low in a particularly reliable way.

The side walls of the horizontal gas flue and/or of the vertical gas flue are advantageously formed from vertically arranged steam generator tubes which are welded to one another in a gastight manner and a number of which are in each case capable of being acted upon in parallel by flow medium.

Adjacent evaporator or steam generator tubes are advantageously welded to one another in a gastight manner via metal bands, what may be referred to as fins. The fin width influences the introduction of heat into the steam generator tubes. The fin width is therefore adapted, preferably as a function of the position of the respective evaporator or steam generator tubes in the steam generator, to a heating and/or temperature profile predeterminable on the gas side. In this case, the predetermined heating and/or temperature profile may be a typical heating and/or temperature profile determined from empirical values or else a rough estimation, such as, for example, a stepped heating and/or temperature profile. By way of the suitably selected fin widths, it is possible, even in the case of widely varying heating of different evaporator or steam generator tubes, to achieve an introduction of heat into all the evaporator or steam generator tubes, in such a way that temperature differences at the outlet of the evaporator or steam generator tubes are kept particularly low. Premature material fatigues are reliably prevented in this way. The steam generator consequently has a particularly long useful life.

The horizontal gas flue advantageously has arranged in it a number of superheater heating surfaces, the tubes of which are arranged approximately transversely to the main flow direction of the fuel gas and are connected in parallel for a throughflow of the flow medium. These superheater heating surfaces, arranged in a suspended form of a construction and also designated as bulkhead heating surfaces, are heated predominantly convectively and follow the evaporator tubes of the combustion chamber on the flow-medium side. A particularly beneficial utilization of the fuel-gas heat is thereby ensured.

Advantageously, the vertical gas flue has a number of convection heating surfaces which are formed from tubes arranged approximately transversely to the main flow direction of the fuel gas. The tubes of a convection heating surface are in this case connected in parallel for a throughflow of the flow medium. These convection heating surfaces, too, are heated predominantly convectively.

In order, furthermore, to ensure a particularly full utilization of the heat of the fuel gas, the vertical gas flue advantageously has an economizer. Advantageously, the burners are arranged on the end wall of the combustion chamber, that is to say on that containment wall of the combustion chamber which is located opposite the outflow orifice to the horizontal gas flue.

A steam generator designed in this way can be adapted particularly simply to the burnup length of the fuel. The burnup length of the fossil fuel is understood as meaning, in this context, the fuel-gas velocity in the horizontal direction at a specific mean fuel-gas temperature, multiplied by the burnup time $t_A$ of the fossil fuel. The maximum burnup length for the respective steam generator is obtained in this case at the steam power output of the steam generator under full load, what may be referred to as full-load operation of the steam generator. The burnup time $t_A$, in turn, is the time which, for example, a coal dust grain requires in order to burn up completely at a specific mean fuel-gas temperature.

In order to keep material damage and undesirable contamination of the horizontal gas flue, for example due to the introduction of molten ash at high temperature, particularly low, the length L of the combustion chamber, defined by the distance between the end wall and the inlet region of the horizontal gas flue, is advantageously at least equal to the burnup length of the fuel during full-load operation of the steam generator. This length L of the combustion chamber will generally be greater than the height of the combustion chamber, measured from the funnel top edge to the combustion chamber ceiling.

In an advantageous refinement, for the particularly favorable utilization of the combustion heat of the fossil fuel, the length L (given in m) of the combustion chamber is selected as a function of the BMCR value W (given in kg/s) of the steam generator, the burnup time $t_A$ (given in s) of the fuel and the outlet temperature $T_{BRK}$ (given in °C.) of the fuel gas from the combustion chamber. BMCR stands for boiler maximum continuous rating and gives the term conventionally used internationally for the maximum continuous power output of a steam generator. This also corresponds to the design power output, that is to say the power output during full-load operation of the steam generator. In this case, with a given BMCR value W of the steam generator, approximately the higher value of the two functions (I) and (II) applies to the length L of the combustion chamber:

$$L(W, t_A)=(C_1+C_2\cdot W)\cdot t_A \quad \text{(I)}$$

and $$L(W,T_{BRK})=(C_3\cdot T_{BRK}+C_4)W+C_5(T_{BRK})^2+C_6\cdot T_{BRK}C_7 \quad \text{(II)}$$

where $C_1$=8 m/s and $C_2$=0.0057 m/kg and $C_3=-1.905\cdot 10^{-4}$ (m·s)/(kg°C.) and $C_4$=0.286 (s·m)/kg and $C_5=3\cdot 10^{-4}$ m/(°C.)$^2$ and $C_6$=−0.842 m/°C. and $C_7$=603.41 m.

"Approximately" is understood to mean in this case a permissible deviation of +20%/−10% from the value defined by the respective function.

The advantages achieved by way of the invention are. For example, that the steam generator has a particularly low space requirement on account of the horizontal combustion chamber and of the vertical gas flue designed for an approximately vertical flow direction of the fuel gas from the bottom upward. This particularly compact form of construction of the steam generator makes it possible, when the steam generator is incorporated into a steam turbine plant, to have particularly short connecting tubes from the steam generator to the steam turbine.

BRIEF DESCRIPTION OF THE DRAWINGS

An exemplary embodiment of the invention is explained in more detail by means of a drawing in which.

DETAILED DESCRIPTION OF THE PREFERRED EMBODIMENTS

Parts corresponding to one another are given the same reference symbols in all the figures.

Figure 1:
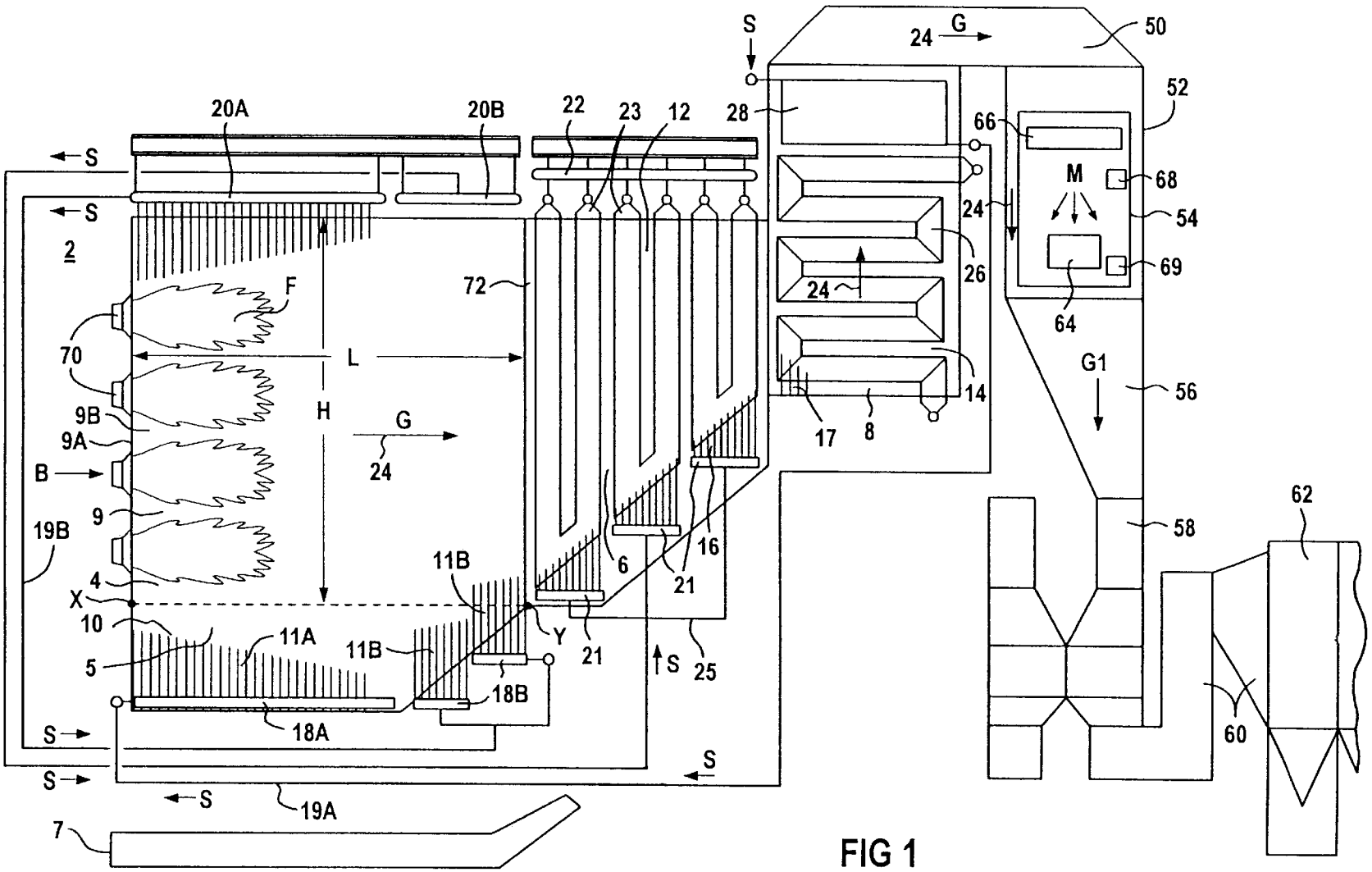
FIG. 1 shows diagrammatically a side view of a fossil-fired steam generator of the dual-flue type.

The steam generator 2 according to FIG. 1 is assigned to a power plant, not illustrated in specific detail, which also comprises a steam turbine plant. The steam generated in the steam generator 2 is in this case used for driving the steam turbine which itself, in turn, drives a generator for current generation. The current generated by the generator is in this case provided for feeding into an interconnected or an island network. Furthermore, a branch-off of a partial quantity of the steam may also be provided for feeding into an external process which is connected to the steam turbine plant and which may also be a heating process.

The fossil-fired steam generator 2 is advantageously designed as a continuous-flow steam generator. It includes a combustion chamber 4 which is designed in a horizontal form of construction and which is followed on the fuel-gas side, via a horizontal gas flue 6, by a vertical gas flue 8. The lower region of the combustion chamber 4 is formed by a funnel 5 with a top edge corresponding to the subsidiary line having the end points X and Y. By way of the funnel 5, when the steam generator 2 is in operation, ash from the fossil flue B may be discharged into an ash removal device 7 arranged below said funnel. The containment walls 9 of the combustion chamber 4 are formed from vertically arranged evaporator tubes 10 welded to one another in a gastight manner. In this case, one containment wall 9 is the end wall 9A and two containment walls 9 are the side walls 9B of the combustion chamber 4 of the steam generator 2. Only one of the two side walls 9B can be seen in the side view, shown in FIG. 1, of the steam generator 2. The evaporator tubes 10 of the side walls 9B of the combustion chamber 4 are subdivided into a first group 11A and a second group 11B. The evaporator tubes 10 of the end wall 9A and the first group 11A of the evaporator tubes 10 are capable of being acted upon in parallel by flow medium S. The second group 11B of the evaporator tubes 10 is also capable of being acted upon in parallel by flow medium S. In order to achieve a particularly favorable throughflow characteristic of the flow medium S through the containment walls 9 of the combustion chamber 4 and, consequently, a particularly good utilization of the combustion heat of the fossil fuel B, the evaporator tubes 10 of the end wall 9A and of the first group 11A precede the evaporator tubes 10 of the second group 11B on the flow-medium side.

The side walls 12 of the horizontal gas flue 6 and/or the side walls 14 of the vertical gas flue 8 are also formed from vertically arranged steam generator tubes 16 and 17 welded to one another in a gastight manner. At the same time, a number of the steam generator tubes 16, 17 may in this case be acted upon in parallel by flow medium S.

The end face 9A and the first group 11A of the evaporator tubes 10 of the combustion chamber 4 are, on the flow-medium side, preceded by a common inlet header system 18A for flow medium S and followed by an outlet header system 20A. Likewise, the second group 11B of the side walls 9B of the evaporator tubes 10 are, on the flow-medium side, preceded by a common inlet header system 18B for the flow medium S and followed by an outlet header system 20B. The inlet header systems 18A and 18B at the same time in each case include a number of parallel inlet headers.

A line system 19A is provided for feeding flow medium S into the inlet header system 18A of the end face 9A of the combustion chamber 4 and of the first group 11A of the evaporator tubes 10 of the side walls 9B of the combustion chamber 4. The line system 19A includes a plurality of parallel-connected lines, which are connected in each case to one of the inlet headers of the inlet header system 18A. The outlet header system 20A is connected on the outlet side to a line system 19B, which is provided for feeding flow medium S into the inlet headers of the inlet header system 18B of the second group 11B of the evaporator tubes 10 of the side walls 9B of the combustion chamber 4.

In the same way, the steam generator tubes 16, capable of being acted upon in parallel by the flow medium S, of the side walls 12 of the horizontal gas flue 6 are preceded by a common inlet header system 21 and followed by a common outlet header system 22. In this case, a line system 25 is provided for feeding flow medium S into the inlet header system 21 of the steam generator tubes 16. Here, too, the line system 25 includes a plurality of parallel-connected lines which are connected in each case to one of the inlet headers of the inlet header system 21. The line system 25 is connected on the inlet side to the outlet header system 20B of the second group 11B of the evaporator tubes 10 of the side walls 9A of the combustion chamber 4. The heated flow medium S leaving the combustion chamber 4 is therefore guided into the side walls 12 of the horizontal gas flue 6.

This configuration of the continuous-flow steam generator 2, with inlet header systems 18A, 18B and 21 and outlet header systems 20A, 20B and 22, makes it possible to have particularly reliable pressure compensation between the parallel-connected evaporator tubes 10 of the combustion chamber 4 or the parallel-connected steam generator tubes 16 of the horizontal gas flue 6, in that, in each case, all the parallel-connected evaporator or steam generator tubes 10 and 16 have the same overall pressure loss. This means that, in the case of an evaporator tube 10 or steam generator tube 16 heated to a greater extent, the throughput must rise, as compared with an evaporator tube 10 or a steam generator tube 16 heated to a lesser extent.

Figure 2:
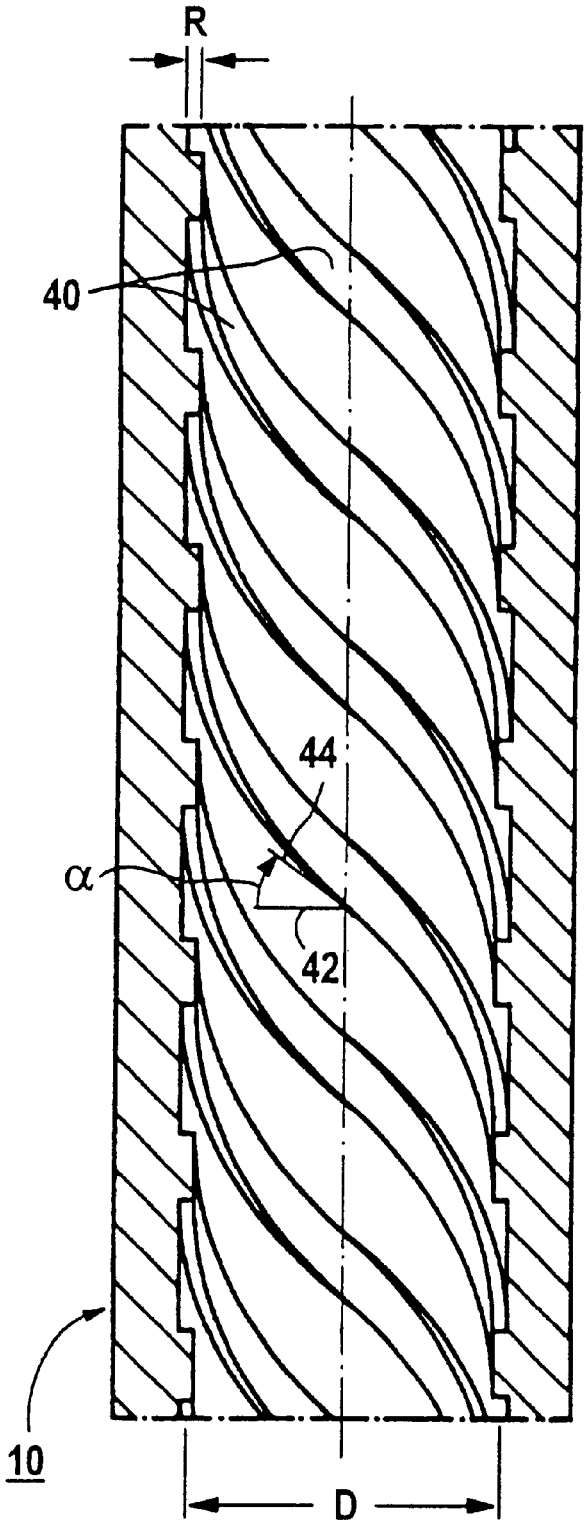
FIG. 2 shows diagrammatically a longitudinal section through an individual evaporator tube.

As illustrated in FIG. 2, the evaporator tubes 10 have, on their inside, ribs 40 which form a type of multiflight thread and have a rib height R.

In this case, the pitch angle $\alpha$ between a plane 42 perpendicular to the tube axis and the flanks 44 of the ribs 40, arranged on the tube inside, is smaller than 55°. As a result, particularly high heat transmission from the inner wall of the evaporator tubes to the flow medium S guided in the evaporator tubes 10, at the same time with particularly low temperatures of the tube wall, is achieved.

The tube inside diameter D of the evaporator tubes 10 of the combustion chamber 4 is selected as a function of the respective position of the evaporator tubes 10 in the combustion chamber 4. The steam generator 2 is thereby adapted to the different amounts of heating of the evaporator tubes 10. This design of the evaporator tubes 10 of the combustion chamber 4 ensures particularly reliably that temperature differences at the outlet of the evaporator tubes 10 are kept particularly low.

Adjacent evaporator or steam generator tubes 10, 16, 17 are welded to one another in a gastight manner via fins in a way not illustrated in any more detail. To be precise, the heating of the evaporator or steam generator tubes 10, 16, 17 may be influenced by suitable choice of the fin width. The respective fin width is therefore adapted to a heating profile, which is predeterminable on the gas side and which depends on the position of the respective evaporator or steam generator tubes 10, 16, 17 in the steam generator. The heating profile may in this case be a typical heating profile determined from empirical values or else a rough estimation. As a result, even in the case of widely differing heating of the evaporator or steam generator tubes 10, 16, 17, temperature differences at the outlet of the evaporator or steam generator tubes 10, 16, 17 are kept particularly low. Material fatigues are thereby reliably prevented, thus ensuring that the steam generator 2 has a long useful life.

As a way for reducing the throughflow of the flow medium S, some of the evaporator tubes 10 are equipped with throttle devices which are not illustrated in specific detail in the drawing.

The throttle devices are designed as perforated diaphragms reducing the tube inside diameter D and, when the steam generator 2 is in operation, bring about a reduction in the throughput of the flow medium S in evaporator tubes 10 heated to a lesser extent, with the result that the throughput of the flow medium S is adapted to the heating. Furthermore, as a way for reducing the throughput of the flow medium S in the evaporator tubes 10 of the combustion chamber 4, one or more lines of the line system 19 or 25 are equipped with throttle devices, in particular throttle fittings. This is not illustrated in specific detail in the drawing.

In the tubing of the combustion chamber 4, it must be remembered that the heating of the individual evaporator tubes 10 welded to one another in a gastight manner differs greatly when the steam generator 2 is in operation. Consequently, the design of the evaporator tubes 10 in terms of their internal ribbing, fin connection to adjacent evaporator tubes 10 and their tube inside diameter D is selected such that, in spite of different heating, all the evaporator tubes 10 have approximately the same outlet temperatures of the flow medium S and sufficient cooling of all the evaporator tubes 10 is ensured for all the operating states of the steam generator 2.

These properties of the steam generator are ensured, in particular, when the steam generator 2 is designed for a comparatively low mass flow density of the flow medium S flowing through the evaporator tubes 10. What is achieved, moreover, by a suitable choice of the fin connections and of the tube inside diameters D is that the fraction of frictional pressure loss in the overall pressure loss is so small that a natural circulation behavior is established: evaporator tubes 10 heated to a greater extent have a higher throughflow than evaporator tubes 10 heated to a lesser extent. What is also achieved thereby is that the evaporator tubes 10 heated to a comparatively greater extent and located in the burner vicinity absorb specifically, with respect to the mass flow, approximately as much heat as the evaporator tubes 10 heated to a comparatively lesser extent, which, in comparison with them, are arranged nearer to the combustion chamber end. A further measure for adapting the throughflow of the evaporator tubes 10 of the combustion chamber 4 to the heating is for throttles to be built into some of the evaporator tubes 10 or into some of the lines of the line system 19. The internal ribbing is in this case designed in such a way that sufficient cooling of the evaporator tube walls is ensured. Thus, by way of the abovementioned measures, all the evaporator tubes 10 have approximately the same outlet temperatures of the flow medium S.

The horizontal gas flue 6 has a number of superheater heating surfaces 23 which are designed as bulkhead heating surfaces and are arranged in a suspended form of construction approximately perpendicularly to the main flow direction 24 of the fuel gas G and the tubes of which are in each case connected in parallel for a throughflow of the flow medium S. The superheater heating surfaces 23 are heated predominantly convectively and follow the evaporator tubes 10 of the combustion chamber 4 on the flow-medium side.

The vertical gas flue 8 through which fuel gas G is capable of flowing from the bottom upward has a number of convection heating surfaces 26 which are capable of being heated predominantly convectively and are formed from tubes arranged approximately perpendicularly to the main flow direction 24 of the fuel gas G. These tubes are in each case connected in parallel for a throughflow of the flow medium S and are integrated into the path of the flow medium S, this is not illustrated in any more detail in the drawing.

Moreover, an economizer 28 is arranged in the vertical gas flue 8 above the convection heating surfaces 26. The economizer 28 is connected on the outlet side, via a line system 19, to the inlet header system 18 assigned to the evaporator tubes 10. In this case, one or more lines of the line system 24, which are not illustrated in specific detail in the drawing, may have throttle fittings in order to reduce the throughflow of the flow medium S.

The vertical gas flue 8, through which fuel gas G is capable of flowing from the bottom upward in an approximately vertical main flow direction 24, is followed, on the outlet side, by a short connecting duct 50. The connecting duct 50 connects the vertical gas flue 8 to a housing 52. A nitrogen removal device 54 for fuel gas G is arranged on the inlet side in the housing 52. The nitrogen removal device 54 for fuel gas G is connected to an air preheater 58 via a feed 56. The air preheater 58, in turn, is connected to an electronic filter 62 via a smoke-gas duct 60.

The nitrogen removal device 54 for fuel gas G is operated according to the method of selective catalytic reduction, what may be referred to as the SCR method. During the catalytic purification of the fuel gas G of the steam generator 2 according to the SCR method, nitrogen oxides ($NO_x$) are reduced to nitrogen ($N_2$) and water ($H_2O$) with the aid of a catalyst and a reducing agent, for example ammonia.

To carry out the SCR method, the nitrogen removal device 54 for fuel gas G includes a catalyst designed as a $DeNO_x$ catalyst 64. The $DeNO_x$ catalyst is arranged in the flow region of the fuel gas G. To introduce ammonia water as reducing agent M into the fuel gas G, the nitrogen removal device 54 for fuel gas G has a metering system 66. In this case, the metering system 66 includes a storage vessel 68 for ammonia water and a compressed-air system 69. The metering system 66 is arranged above the $DeNO_x$ catalyst 64 in the nitrogen removal device 54.

A steam generator 2 is designed with a horizontal combustion chamber 4 having a particularly low overall height and can thus be erected at a particularly low outlay in production and assembly terms. For this purpose, the combustion chamber 4 of the steam generator 2 has a number of burners 70 for fossil fuel B, which are arranged, level with the horizontal gas flue 6, on the end wall 11 of the combustion chamber 4.

So that the fossil fuel B, for example coal in solid form, burns up particularly completely in order to achieve particularly high efficiency and material damage to the first superheater heating surface 23, as seen on the fuel-gas side, of the horizontal gas flue 6 and contamination of this, for example due to the introduction of molten ash at high temperature, are prevented in a particularly reliable way, the length L of the combustion chamber 4 is selected such that it exceeds the burnup length of the fuel B during full-load operation of the steam generator 2. The length L is in this case the distance from the end wall 9A of the combustion chamber 4 to the inlet region 72 of the horizontal gas flue 6. The burnup length of the fuel B is in this case defined as the fuel-gas velocity in the horizontal direction at a specific mean fuel-gas temperature, multiplied by the burnup time $t_A$ of the fossil fuel B. The maximum burnup length for the respective steam generator 2 is obtained during full-load operation of the steam generator 2. The burnup time $t_A$ of the fuel B is, in turn, the time which, for example, a coal dust grain of average size requires to burn up completely at a specific mean fuel-gas temperature.

In order to ensure particularly favorable utilization of the combustion heat of the fossil fuel B, the length L (given in m) of the combustion chamber 4 is suitably selected as a function of the outlet temperature of the fuel gas G from the combustion chamber 4 $T_{BRK}$ (given in °C.), of the burnup time $t_A$ (given in s) of the fuel B and of the BMCR value W (given in kg/s) of the steam generator 2. In this context, BMCR stands for boiler maximum continuous rating. The BMCR value W is a term conventionally used internationally for the maximum continuous power output of a steam generator. This also corresponds to the design power output, that is to say to the power output during full-load operation of the steam generator. This horizontal length L of the combustion chamber 4 is in this case greater than the height H of the combustion chamber 4. The height H is in this case measured from the funnel top edge of the combustion chamber 4, marked in FIG. 1 by the subsidiary line having the end points X and Y, to the combustion chamber ceiling. In this case, the length L of the combustion chamber 4 is determined approximately via the two functions (I) and (II)

$$L(W, t_A)=(C_1+C_2\cdot W)\cdot t_A \quad \text{(I)}$$

and $$L(W, T_{BRK})=(C_3\cdot T_{BRK}+C_4)W+C_5(T_{BRK})^2+C_6\cdot T_{BRK}+C_7 \quad \text{(II)}$$

where $C_1$=8 m/s and $C_2$=0.0057 m/kg and $C_3=-1.905\cdot 10^{-4}$(m·s)/(kg°C.) and $C_4$=0.286(s·m)/kg and $C_5=3\cdot 10^{-4}$m/(°C.)$^2$ and $C_6$=−0.842 m/°C. and $C_7$=603.41 m.

"Approximately" in this case is understood to mean a permissible deviation of +20%/−10% from the value defined by the respective function. At the same time, in the case of an arbitrary, but fixed BMCR value W of the steam generator, the higher value of the functions (I) and (II) always applies to the length L of the combustion chamber 4.

Figure 3:
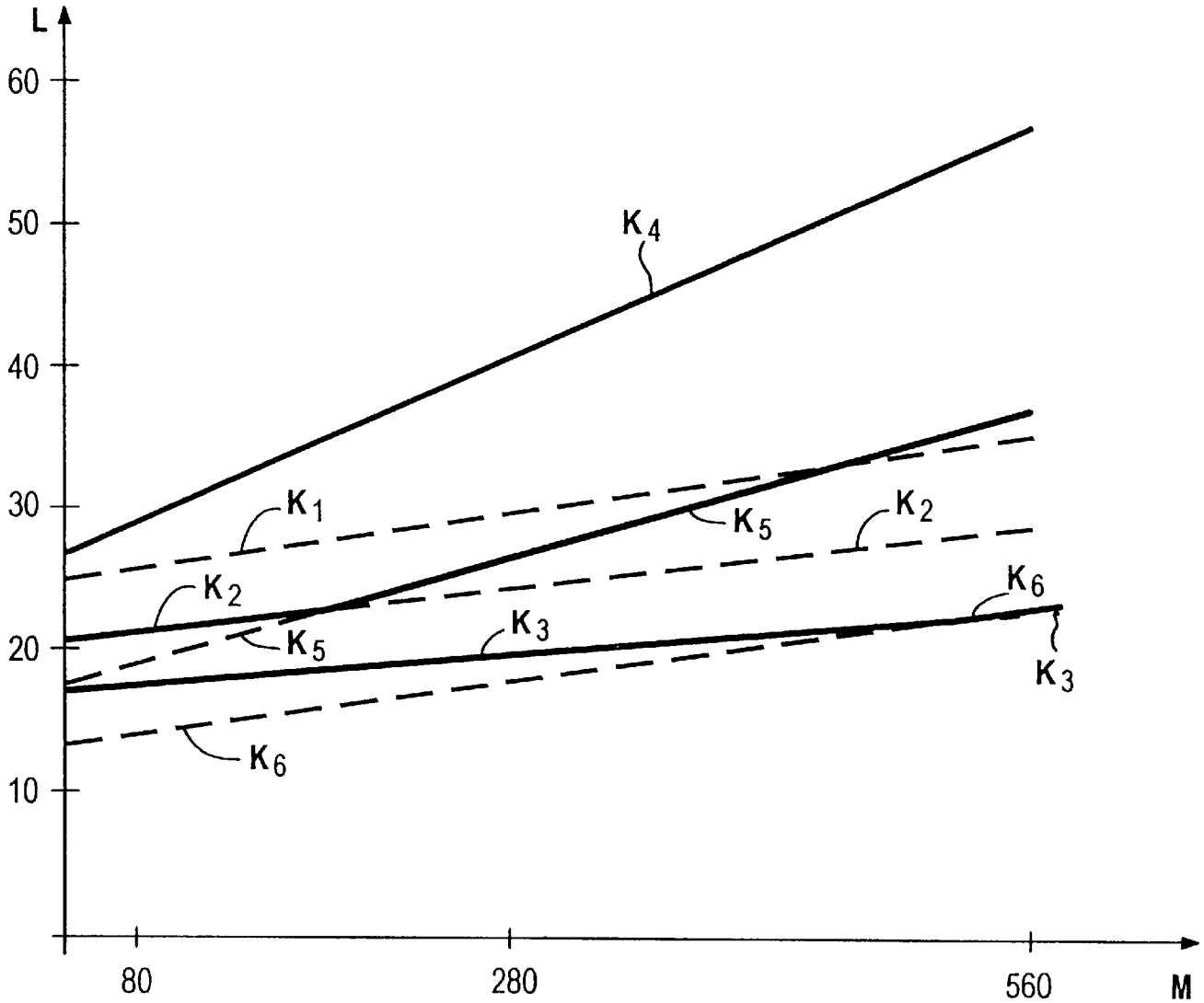
FIG. 3 shows a coordinate system with the curves $K_1$ to $K_6$.

As an example of a calculation of the length L of the combustion chamber 4 as a function of the BMCR value W of the steam generator 2, six curves $K_1$ to $K_6$ are depicted in the coordinate system according to FIG. 3. Here, the curves are in each case assigned the following parameters:

$K_1$: $t_A$=3 s according to (1), $K_2$: $t_A$=2.5 s according to (1), $K_3$: $t_A$=2 s according to (1), $K_4$: $T_{BRK}$=1200° C. according to (2), $K_5$: $T_{BRK}$=1300° C. according to (2), and $K_6$: $T_{BRK}$=1400° C. according to (2).

Thus, for example for a burnup time $t_A$=3 s and an outlet temperature $T_{BRK}$=1200° C. of the fuel gas G from the combustion chamber 4, the curves $K_1$ and $K_4$ are to be used to determine the length L of the combustion chamber 4.

This results, in the case of a predetermined BMCR value W of the steam generator 2 of W=80 kg/s, in a length of L=29 m according to $K_4$, of W=160 kg/s, in a length of L=34 m according to $K_4$, of W=560 kg/s, in a length of L=57 m according to $K_4$.

For example, the curves $K_2$ and $K_5$ are to be used for the burnup time $T_A$=2.5 s and the outlet temperature of the fuel gas G from the combustion chamber $T_{BRK}$=1300° C. This results, in the case of a predetermined BMCR value W of the steam generator 2 of W=80 kg/s, in a length of L=21 m according to $K_2$, of W=180 kg/s, in a length of L=23 m according to $K_2$ and $K_5$, of W=560 kg/s, in a length of L=37 m according to $K_5$.

The burnup time $t_A$=2 s and the outlet temperature of the fuel gas G from the combustion chamber $T_{BRK}$=1400° C. are assigned, for example, to the curves $K_3$ and $K_6$. This results, in the case of a predetermined BMCR value W of the steam generator 2 of W=80 kg/s, in a length of L=18 m according to $K_3$, of W=465 kg/s, in a length of L=21 m according to $K_3$ and $K_6$, of W=560 kg/s, in a length of L=23 m according to $K_6$.

When the steam generator 2 is in operation, fossil fuel B and air are supplied to the burners 70. The air is in this case preheated in the air preheater by way of the residual heat of the fuel gas G and then, this not being illustrated in any more detail in the drawing, is compressed and supplied to the burner 70. The flames F of the burners 70 are in this case oriented horizontally. By virtue of the form of construction of the combustion chamber 4, a flow of the fuel gas G occurring during combustion is generated in the approximately horizontal main flow direction 24.

The fuel gas G passes, via the horizontal gas flue 6, into the vertical gas flue 8 through which fuel gas G is capable of flowing from the bottom upward.

Downstream of the vertical gas flue 8 on the outlet side, the fuel gas G passes, via the connecting duct 50, into the nitrogen removal device 54 for fuel gas G. Via the nitrogen removal device 54 for fuel gas G, a specific quantity of ammonia water is injected as reducing agent M into the fuel gas G with the aid of compressed air as a function of the type of fuel B operating the steam generator 2. This is necessary, since the degree of separation of the nitrogen oxides ($NO_x$) depends on the type of fossil fuel B operating the steam generator 2. A particularly reliable removal of nitrogen from the fuel gas G is thereby ensured in all the operating states of the steam generator 2.

The purified fuel gas G1 leaves the nitrogen removal device 54 for fuel gas G via a feed 56 which issues into the air preheater 58. A preheating of the air to be supplied to the burners 70 for the combustion of the fossil fuel B takes place in the air preheater 58. The fuel gas G leaves the air preheater 58 via the smoke-gas duct 60 and passes via the electronic filter 62 into the environment.

Flow medium S entering the economizer 28 passes via the line system 19A into the inlet header system 18A which is assigned to the end wall 9A and to the evaporator tubes 10 of the first group 11A of the side walls 9B of the combustion chamber 4 of the steam generator 2. The steam or a water/steam mixture occurring in the vertically arranged evaporator tubes 10 of the combustion chamber 4 of the steam generator 2, which are welded to one another in a gastight manner is collected in the outlet header system 20A for flow medium S. The steam or the water/steam mixture passes from there, via the line system 19B, into the inlet header system 18B which is assigned to the second group 11B of the evaporator tubes 10 of the side walls 9B of the combustion chamber 4. The steam or a water/steam mixture occurring in the vertically arranged evaporator tubes 10 of the combustion chamber 4 of the steam generator 2 which are welded to one another in a gastight manner is collected in the outlet header system 20B for flow medium S. The steam and/or the water/steam mixture passes from there, via the line system 25, into the inlet header system 21 assigned to the steam generator tubes 16 of the side walls 12 of the horizontal gas flue. The steam and/or the water/steam mixture occurring in the evaporator tubes 16 passes via the outlet header system 22 into the walls of the vertical gas flue 8 and from there, in turn, into the superheater heating surfaces 23 of the horizontal gas flue 6. In the superheater heating surfaces 23, further superheating of the steam takes place, the latter subsequently being supplied for utilization, for example for driving a steam turbine.

In the steam generator 2, the selection of the length L of the combustion chamber 4 as a function of the BMCR value W of the steam generator 2 ensures that the combustion heat of the fossil fuel B is utilized particularly reliably. Moreover, the steam generator 2 requires a particularly small amount of space on account of its horizontal combustion chamber 4 and its nitrogen removal device 54 located directly downstream of the vertical gas flue 8. At the same time, a particularly reliable removal of nitrogen from the fuel gas G is ensured in a particularly simple way in all the operating states of the steam generator 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A steam generator with a nitrogen removal device for fuel gas having a combustion chamber for fossil fuel, which is followed on a fuel-gas side, via a horizontal gas flue and a vertical gas flue, by a nitrogen removal device for fuel gas, the combustion chamber comprising:

a number of burners arranged level with the horizontal gas flue, and wherein the vertical gas flue is designed for substantially vertical flow of the fuel gas from a bottom thereof upward, and the nitrogen removal device for the fuel gas is designed for substantially vertical flow of the fuel gas from a top thereof downward.

2. The steam generator as claimed in claim 1, further comprising an air preheater, wherein a purified fuel gas leaving the nitrogen removal device for fuel gas is used for the heating of air.

3. The steam generator as claimed in claim 2, wherein the nitrogen removal device for the fuel gas includes a $DeNO_x$ catalyst.

4. The steam generator as claimed in claim 1, wherein the nitrogen removal device for the fuel gas includes a $DeNO_x$ catalyst.

5. The steam generator as claimed in claim 1, wherein containment walls at least partially define the combustion chamber, the containment walls are formed from vertically arranged evaporator tubes welded to one another in a gastight manner, a number of the evaporator tubes being capable of being acted upon in parallel by a flow medium.

6. The steam generator as claimed in claim 5, wherein one of the containment walls of the combustion chamber is an end wall and two of the containment walls are side walls of the combustion chamber, the side walls being subdivided into a first group and a second group of evaporator tubes, the end wall and the first group of the evaporator tubes being capable of being acted upon in parallel by the flow medium and on the flow-medium side, the second group of the evaporator tubes capable of being acted upon in parallel by the flow medium.

7. The steam generator as claimed in claim 6, wherein the burners are arranged on the end wall of the combustion chamber.

8. The steam generator as claimed in claim 7, wherein a length of the combustion chamber is selected, as a function of a BMCR value (W), of a burnup time ($t_A$) of the burners, and of an outlet temperature ($T_{BRK}$) of the fuel gas from the combustion chamber, substantially according to the two functions (I) and (II)

$$L(W, t_A)=(C_1+C_2\cdot W)\cdot t_A \quad \text{(I)}$$

and $$L(W, T_{BRK})=(C_3\cdot T_{BRK}+C_4)W+C_5(T_{BRK})^2+C_6\cdot T_{BRK}+C_7 \quad \text{(II)}$$

where $C_1$=8 m/s and $C_2$=0.0057 m/kg and $C_3=-1.905\cdot 10^{-4}$ (m·s)/(kg°C.) and $C_4$=0.286 (s·m)/kg and $C_5=3\cdot 10^{-4}$ m/(°C.)$^2$ and $C_6$=−0.842 m/°C. and $C_7$=603.41 m, wherein a respectively higher value of the length of the combustion chamber applies to a BMCR value (W).

9. The steam generator as claimed in claim 6, wherein a length of the combustion chamber, defined by the distance between the end wall of the combustion chamber and an inlet region of the horizontal gas flue, is at least equal to a burnup length of a fuel during full-load operation of the steam generator.

10. The steam generator as claimed in claim 5, wherein the evaporator tubes capable of being acted upon in parallel by the flow medium are, on the flow-medium side, preceded by a common inlet header system and followed by a common outlet header system.

11. The steam generator as claimed in claim 5, wherein a tube inside diameter of a number of the evaporator tubes of the combustion chamber is selected as a function of a respective position of the evaporator tubes in the combustion chamber.

12. The steam generator as claimed in claim 5, wherein a number of the evaporator tubes carry on an inside portion thereof ribs forming a multiflight thread.

13. The steam generator as claimed in claim 12, wherein a pitch angle between a plane perpendicular to a tube axis and flanks of the ribs arranged on the tube inside is smaller than 60°.

14. The steam generator as claimed in claim 5, wherein a number of the evaporator tubes have a throttle device.

15. The steam generator as claimed in claim 5, wherein a line system is provided for feeding the flow medium into the evaporator tubes of the combustion chamber, the line system having a number of throttle devices in order to reduce a throughflow quantity of the flow medium.

16. The steam generator as claimed in claim 15, wherein the throttle devices are throttle fittings.

17. The steam generator as claimed in claim 5, wherein the evaporator tubes capable of being acted upon in parallel by flow medium are, on the flow-medium side, preceded by a common inlet header system and followed by a common outlet header system.

18. The steam generator as claimed in claim 1, wherein the side walls of the horizontal gas flue are formed from vertically arranged steam generator tubes, which are welded to one another in a gastight manner, and a number of the steam generator tubes which are capable of being acted upon in parallel by a flow medium.

19. The steam generator as claimed in claim 18, wherein the steam generator tubes are welded to one another in a gastight manner via fins, a fin width of the fins being selected as a function of a respective position of the steam generator tubes in the combustion chamber of the horizontal gas flue.

20. The steam generator as claimed in claim 1, wherein side walls of the vertical gas flue are formed from vertically arranged steam generator tubes, which are welded to one another in a gastight manner, and a number of the steam generator tubes which are capable of being acted upon in parallel by the flow medium.

21. The steam generator as claimed in claim 20, wherein adjacent evaporator tubes are welded to one another in a gastight manner via fins, a fin width of the fins being selected as a function of a respective position of the evaporator tubes in the combustion chamber of the vertical gas flue.

22. The steam generator as claimed in claim 1, wherein a number of superheater heating surfaces are arranged in a suspended form of construction in the horizontal gas flue.

23. The steam generator as claimed in claim 1, wherein a number of convection heating surfaces are arranged in the vertical gas flue.

24. The steam generator as claimed in claim 1, wherein an economizer is arranged in the vertical gas flue.

25. The steam generator as claimed in claim 1, wherein a length of the combustion chamber is selected as a function of a BMCR value (W).

* * * * *